United States Patent [19]

Moore et al.

[11] Patent Number: 4,747,283

[45] Date of Patent: May 31, 1988

[54] BOOSTED DRIVE FOR PRESSURE DIE OF A TUBE BENDER

[75] Inventors: Carl A. Moore, Elburn; Ralph J. Meehan, McHenry, both of Ill.

[73] Assignee: Teledyne Industries, Los Angeles, Calif.

[21] Appl. No.: 88,716

[22] Filed: Aug. 24, 1987

[51] Int. Cl.[4] ..... B21D 7/04; B21D 7/12

[52] U.S. Cl. ..... 72/8; 72/21; 72/27; 72/154

[58] Field of Search ..... 72/8, 9, 19, 20, 21, 72/22, 23, 27, 149, 154, 155, 159

[56] References Cited

U.S. PATENT DOCUMENTS

| | | | |
|---|---|---|---|
| 2,312,122 | 2/1943 | Parker et al. | 72/149 |
| 2,357,873 | 9/1944 | Bower | 72/154 X |
| 2,810,422 | 10/1957 | Bower | 72/154 X |
| 3,303,683 | 2/1967 | Schmidt | 72/154 |
| 3,553,990 | 1/1971 | Suding et al. | 72/8 |
| 4,126,030 | 11/1978 | Zollweg et al. | 72/154 |
| 4,201,073 | 5/1980 | Eaton | 72/155 |

FOREIGN PATENT DOCUMENTS

| | | | |
|---|---|---|---|
| 1752566 | 8/1973 | Fed. Rep. of Germany | 72/154 |

*Primary Examiner*—E. Michael Combs

*Attorney, Agent, or Firm*—Wood, Dalton, Phillips, Mason & Rowe

[57] ABSTRACT

A tube bender has multiple rotatable bend dies of differing radii and a pressure die engaging the outer surface of the trailing portion of the tube tangential to the bend. A drive for the pressure die is provided to move the pressure die parallel to the tangential tube portion during bending. The drive includes sensors for determining both the drive speed of the pressure die and the rotation rate of the bend die, a computer which converts the detected rotation rate into a center line speed for the tube, and a servomechanism which controls the drive structure so as to drive the pressure die at a speed which has a selected ratio to the tube center line speed.

11 Claims, 1 Drawing Sheet

BOOSTED DRIVE FOR PRESSURE DIE OF A TUBE BENDER

DESCRIPTION

1. Technical Field

The present invention relates to a drive for a pressure die of a tube bender, and more particularly to a boosted drive which advances the pressure die during bending at a speed which is a selected proportion of the center-line speed of the tube being bent.

2. Background Art

Tube bending machines are well-known in the art. In one common type of machine, a tube is secured between a bend die and clamp die which rotate together, drawing the lead portion of the tube therewith to bend it around the bend die. A pressure die engages the outer side of the trailing portion of the tube and a wiper die engages the straight trailing portion of the tube on its inner side. This general configuration is shown in FIGS. 1 and 2 and is further discussed below.

In some bending machines such as described above, the pressure die is driven forward along with the trailing portion of the tube at a boosted speed which is greater than the speed of the trailing portion of the tube as it is pulled forward by the bend die during bending. Such boosted drive helps to insure that the outer wall of the tube will not be stretched so as to have an undesirably thin section.

U.S. Pat. No. 2,810,422 discloses such a boosted drive having a mechanical connection between the pressure die and bend die. However, it is difficult to adjust this drive for different diameter bend dies. This is a particularly serious problem for benders which have multiple bend dies.

Another boosted drive which has been used has a hydraulic drive with a valve system which may be manually adjusted to change the drive boost. This drive, however, is imprecise as it does not vary the pressure die movement with the actual speed of the bend die (which, in practice, can vary both during a bend and between different bends). Further, the valve system is adjusted through a trial and error process which must be repeated when the bender is used with different material and/or radius tubes or to make different diameter bends.

The present invention is directed toward overcoming one or more of the problems as set forth above.

SUMMARY OF THE INVENTION

In one aspect of the present invention, a tube bender is disclosed having a necessary pressure die engaging the outer diameter of the trailing portion of the tube tangential to the bend. A drive for the pressure die is provided to move the pressure die parallel to the trailing tangential tube portion during bending. The drive includes sensors for determining both the drive speed of the pressure die and the rotation rate of the bend die, a computer which converts the detected rotation rate into a center line speed for the tube, and a servomechanism which controls the drive structure so as to drive the pressure die at a speed which has a selected ratio to the tube center line speed.

It is one object of the present invention to provide a pressure die drive which provides a boosted drive for the pressure die at any selected ratio to the tube center line speed.

It is another object of the present invention to provide a drive whereby the boosted drive is a selected ratio of the actual speed of the tube during all phases of bending.

Yet another object of the present invention is to provide a drive which may be easily and precisely adjusted for different radii bend dies.

DESCRIPTION OF THE PREFERRED EMBODIMENT

Figure 1:
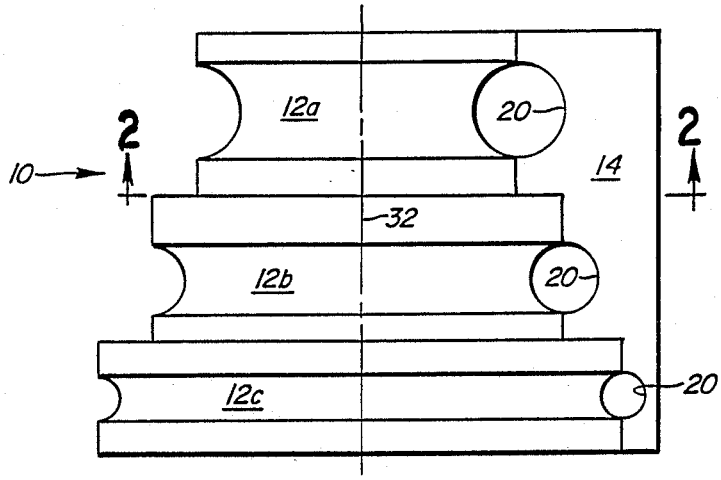
FIG. 1 is a view of a bend head having multiple bend dies, as viewed along line 1—1 in FIG. 2.
Figure 2:
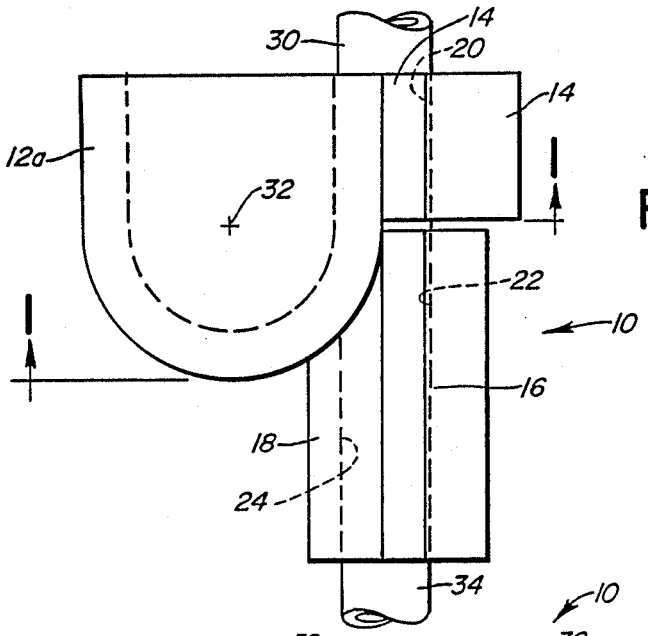
FIG. 2 is a top view of the dies of a bend head.

A bend head 10 is shown in FIGS. 1 and 2 having multiple bend dies 12*a–c* of different radii and adapted to receive different diameter tubes. The bend head 10 also includes a clamp die 14, pressure die 16, and wiper die 18, all shown in FIG. 2 in their configuration immediately prior to bending.

The clamp die 14, pressure die 16, and wiper die 18 all have multiple concave recesses 20, 22, 24 to correspond to the multiple bend dies 12*a–c*. Alternatively, in those embodiments where the bend dies are all adapted to receive the same diameter tube, clamp, pressure and wiper dies having single recesses may be used where those dies may be suitably aligned with the appropriate bend die.

Referring now to FIG. 2, operation of the bend head 10 is as follows. When a tube 30 is appropriately positioned in the bend head 10, the clamp die 14 is biased against the bend dies 12*a–c* to clamp the tube 30 therebetween. The bend dies 12*a–c* and clamp die 14 are then rotated together about the bend die axis 32, drawing the tube 30 along with them. The trailing portion of the tube 30 is drawn through the wiper and pressure dies 18, 16 which hold the tube trailing portion 34 in the desired tangential orientation.

As previously discussed, such bend heads 10 commonly also drive the pressure die 16 forward (up in FIG. 2) along with the tube trailing portion 34 at a boosted speed which is faster than the tube trailing portion 34 is drawn about the bend die 12*a*. This effectively jams the tube 30 into the bend so as to prevent the tube 30, and particularly its outer wall, from being formed with non-uniform and/or undesirably thin portions.

Figure 3:
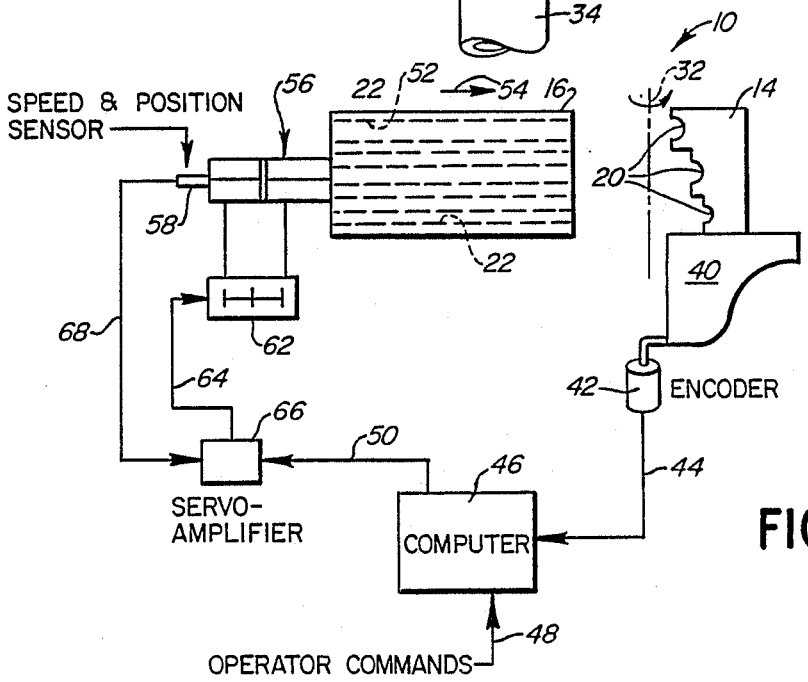
FIG. 3 is a schematic representation of the pressure die drive structure of the present invention.

The present invention, which generally operates in the above manner, is shown in detail in FIG. 3. Specifically, the clamp die 14 is appropriately carried on, for example, a swing arm 40 which both moves the clamp die 14 into position against the bend dies 12*a–c* and pivots with the bend dies 12*a–c*. A digital encoder 42 is provided to measure the rate of rotation of the swing arm 40 and bend dies 12*a–c* about the bend die axis 32, and the generated signal 44 is sent to a computer 46.

The computer 46 has stored therein the relevant information (namely, the radius) for the various bend dies 12*a–c* and, with the bend die 12*a*, 12*b*, or 12*c* being used appropriately identified (by, e.g., an operator command 48), converts the rotation rate into a center line speed of the tube 30 being bent. For example, if the bend die has a 10 inch radius and is rotating at a rate of 30° per second, the center line speed of the tube 30 is 5.236 inches per second.

The computer 46 also receives operator commands as to the desired boost (e.g., 20% greater than the tube center line speed). This information is then used to generate a signal 50 indicating the desired boosted drive speed of the pressure die 16.

The pressure die 16 is driven forward in the direction of the arrow 54 by a suitable piston and cylinder 56 having a speed and position sensor 58, one such structure which is suitable being commercially available from MTS Systems Corporation, Temposonic Sensors Division, of Plainview, N.Y.

A servo valve 62 controls the piston and cylinder 56 and is itself controlled by a signal 64 from a servo amplifier 66. The servo amplifier 66 compares the signal 68 generated by the speed and position sensor 58 (as to the actual speed of the pressure die 16) to the signal 50 generated by the computer 46 (as to the desired speed for the pressure die 16), and in response thereto signals the servo valve 62 to either speed up or slow down the piston and cylinder 56 driving the pressure die 16.

As will be apparent to a skilled artisan, the pressure die drive structure is virtually instantaneously responsive to variations in the rotation rate of the bend die 12*a–c*. Accordingly, this drive can be advantageously used even with tube benders which accommodate only a single bend die. Also, the pressure die 16 will provide a uniform bias to the tube 30 so that its walls have a relatively uniform thickness without undesirably thin portions. Further, this drive may be easily varied both to change the boost factor and to accommodate different radius bend dies, without requiring costly and time-consuming trial and errors when changing between bend dies.

Other aspects, objects and advantages of the invention may be obtained from a study of the drawings, the specification and the appended claims.

We claim:

1. In combination with a tube bender supporting a rotatable bend die about which a tube may be bent and a pressure die engaging the outer surface of the portion of the tube tangential to the bend, a pressure die drive structure comprising:

means for driving said pressure die parallel with said tangential tube portion during bending;

means for sensing the drive speed of the pressure die;

means for detecting the rotation rate of the bend die;

means for converting the detected rotation rate into a centerline speed for the tube being bent around a selected bend die; and means for controlling the pressure die drive means in response to the sensing means and converting means, to drive said pressure die at a speed which is a selected ratio to the tube centerline speed.

2. The drive structure of claim 1, wherein the tube bender supports multiple bend dies.

3. The drive structure of claim 2, wherein the converting means is a computer storing the radius of each bend die and accepting operator commands identifying the selected bend die.

4. The drive structure of claim 1, wherein the detecting means is an encoder signalling the rotation rate to the computer.

5. The drive structure of claim 1, wherein the control means comprises:

a servo valve controlling the drive means; and a servo amplifier comparing the drive speed and the centerline speed and controlling the servo valve in response thereto.

6. A machine for bending a tube, comprising:

multiple bend dies rotatable about an axis to bend a tube around a selected bend die;

a clamp die adapted to secure the lead portion of the tube to the selected bend die;

a pressure die adapted to engage the trailing portion of the tube;

means for driving said pressure die forward with the tube trailing portion at a speed which has a selected ratio to the speed of the centerline of the tube lead portion, including means for detecting the rotation rate of the bend dies, means for converting the rotation rate of the selected bend die to a tube centerline speed, means for sensing the speed of the pressure die, and means for controlling the drive means in response to the sensing means and converting means.

7. The tube bending machine of claim 6, wherein said drive control means compares the tube centerline speed to the pressure die speed, and operates the pressure die drive means to drive the pressure die at a speed which has a selected ratio to the tube centerline speed.

8. The tube bending machine of claim 6, wherein the detecting means includes a digital encoder.

9. The tube bending machine of claim 6, wherein the converting means is a computer storing the radius of each bend die and accepting operator commands identifying the selected bend die.

10. The tube bending machine of claim 9, wherein the detecting means is a digital encoder signalling the rotation rate to the computer.

11. The tube bending machine of claim 6, wherein the controlling means comprises:

a servo valve controlling the drive means; and a servo amplifier comparing the pressure die drive speed and the tube centerline speed and controlling the servo valve in response thereto.

* * * * *